United States Patent [19]

Rush

[11] Patent Number: 4,613,135

[45] Date of Patent: Sep. 23, 1986

[54] QUICK CHANGE DEVICE FOR A BASKETBALL GOAL

[76] Inventor: Richard R. Rush, 907 S. Vandalia, Tulsa, Okla. 74112

[21] Appl. No.: 815,900

[22] Filed: Jan. 3, 1986

[51] Int. Cl.[4] ..... A63B 63/08

[52] U.S. Cl. ..... 273/1.5 R; 248/223.4; 248/225.1

[58] Field of Search ..... 273/1.5 R; 248/223.4, 248/224.1, 224.2, 225.1, 245

[56] References Cited

U.S. PATENT DOCUMENTS

| | | | |
|---|---|---|---|
| 1,284,422 | 11/1918 | Morris | 248/223.4 X |
| 1,522,957 | 1/1925 | Kennedy | 273/1.5 R |
| 2,786,678 | 3/1957 | Fink | 273/1.5 R |
| 3,788,642 | 1/1974 | Matras et al. | 273/1.5 R |
| 4,133,509 | 1/1979 | Kalbow et al. | 248/225.1 X |
| 4,150,381 | 4/1979 | Verini | 248/223.4 X |
| 4,176,580 | 12/1979 | Gallegos | 248/224.1 X |
| 4,218,058 | 8/1980 | Hilbert et al. | 273/1.5 R |
| 4,348,022 | 9/1982 | O'Donnell | 273/1.5 R |
| 4,397,464 | 8/1983 | Krug | 273/1.5 R |

FOREIGN PATENT DOCUMENTS

| | | | |
|---|---|---|---|
| 2042122 | 2/1972 | Fed. Rep. of Germany | 248/223.4 |
| 701081 | 1/1931 | France | 248/223.4 |
| 230471 | 1/1944 | Switzerland | 248/224.2 |
| 244304 | 9/1946 | Switzerland | 248/223.4 |

*Primary Examiner*—Paul E. Shapiro

*Attorney, Agent, or Firm*—Robert E. Massa

[57] ABSTRACT

A quick change device for a basketball goal comprises a receptable member securable to a basketball backboard and a goal-mounting member for slidable mounting on the receptacle member. The receptacle member includes a back plate upon which a pair of guide members are positioned to form a vertical guide channel. The goal-mounting member includes a tongue adaptable to fit slidably into the guide channel. The tongue includes a longitudinal slot extending inwardly from a lower end to receive a bolt secured to the receptacle member so that a wing nut can be secured on the bolt to hold the goal-mounting member securely in place. A larger than standard size goal ring is attached to the goal-mounting member. In this manner, when desired, a larger than standard size basketball goal ring may be interchangeable with a conventional goal ring.

12 Claims, 3 Drawing Figures

QUICK CHANGE DEVICE FOR A BASKETBALL GOAL

FIELD OF THE INVENTION

My invention relates to basketball goals, and more particularly, to basketball goals which may be quickly and easily mounted on a backboard or similar support. Still more particularly, my invention relates to improvements in mounting basketball goals in which a quick-change means of mounting basketball goals is adaptable for two or more different types of basketball goal members so that a change in goal type may be quickly made as desired

BACKGROUND OF THE INVENTION

Basketball has long been a recreational game from the time of its casual invention by Dr. Naismith. Since that time, basketball has steadily become refined to a competitive game using standardized equipment of benefit only to the most skillful players, along with rules which are best followed by those players who are in the best physical condition.

As a result, in recent times, public gymnasiums and playgrounds have been experiencing a lack of participation in basketball as a recreational sport because of the skill needed to compete in the game, primarily because the ball and the goal apparatus have evolved to standard equipment commensurate with the playing ability of only the most skillful players. The most skillful players comprise only a small percentage of the potential players, that is, only a small percentage of the people who would otherwise engage in the game for recreation.

As today's fixed equipment is constructed, both interiorly as in a school gymnasium, or exteriorly as on a playground, the usual standard size goal members are employed, rigidly in place, regardless of whether the players are to be teams of skilled athletes competing, or a group assembled informally just for the exercise and entertainment provided by the sport.

I have found numerous modified versions of the basketball goal equipment in the prior art. However, it appears that the greatest interest has been in the design of separate stands for basketball hoops and the design of modified versions of the game itself, rather than interest in adapting a goal member to accomodate players of various abilities.

The prior art that I have found includes the following patents:

U.S. Pat. No. D-235,897 to Breneman
U.S. Pat. No. 1,522,957 to Kennedy
U.S. Pat. No. 2,473,908 to Rubin
U.S. Pat. No. 2,534,067 to Rubin
U.S. Pat. No. 2,838,308 to Polite
U.S. Pat. No. 2,939,707 to Lemelson
U.S. Pat. No. 3,941,382 to Clark
U.S. Pat. No. 4,145,044 to Welson et al
U.S. Pat. No. 4,171,808 to Bauer
U.S. Pat. No. 4,218,058 to Hilbert et al
U.S. Pat. No. 4,300,764 to Burke

SUMMARY OF THE INVENTION

The primary object of my invention is to provide a basketball goal system which is simple in construction, easy to install, and convenient to use.

Another object of my invention is to provide a basketball goal system which is adaptable for installation on a permanent support member.

Another object of my invention is to provide a basketball goal device which is readily interchangeable on a support member with a conventional goal member.

Another object of my invention is to provide an inexpensive basketball goal device which is a variation of a conventional goal device in order to make possible a game found enjoyable by players of limited basketball playing skill.

Still another object of my invention is to provide a basketball goal system which is adaptable for quick and easy interchange with a conventional goal member.

Still another object of my invention is to provide a basketball goal system which may be easily mountable on a conventional basketball support.

Still another object of my invention is to provide a modified version of a basketball goal system which is interchangeably mountable with a conventional member at substantially the same height as the conventional goal member to attract players of lesser skills while those players gain confidence in playing ability.

I have devoted a great deal of time to the study of the game of basketball and to the equipment which is a part of the conventional game.

As I observed above, my research into the game of basketball showed that fewer people were actively interested in the game, either as a competitive sport or as a recreational game. I found that this decreasing interest was primarily because the standardized goal, also referred to as a ring, was at a height and of a circular dimension, that the game required the player to acquire considerable skill before he would be able to score points consistently. The standard basketball goal is only slightly larger in diameter than the official size basketball.

Therefore, I reasoned that if the goal, or ring, were larger in diameter, it would be easier for people of only limited basketball playing skill to score points, and then interest in the game would increase as an informal sport or casual exercise.

I also noticed that the standard basketball goal is attached to a spacing plate, in the same plane as the goal, and this spacing plate is secured to the backboard, or support member.

The standard spacing plate spaces the goal, or ring, five and one-half inches from the backboard. I have noticed that the wide spacing plate presents two problems for the player. First, the wide spacing plate makes more difficult any shot the player might attempt as a re-bound shot from the backboard into the basket. Second, the wide spacing plate causes a high percentage of the shots to bounce away from the goal, should the ball hit the spacing plate, instead of falling through the basket.

I have further designed my goal member to have a narrow spacing plate, which now lessens the possibility that the ball will bound away from the goal if the ball hits the goal in the area of the spacing plate. In my invention there is practically no room for the ball to encounter a distracting structure. Consequently, the player's scoring potential increases considerably.

As I discussed above, I found that most innovations dealt with separate goal equipment rather than providing goal components which may be substitued for, or be interchangeable with, standard goal components.

In my invention, I have designed basketball goal equipment which may be quickly and easily interchanged with standard equipment on the backboard to provide a secure mounting fixture for both types of goal structures.

A basic feature of my invention is a receptacle member which is secured to the basketball backboard in place of the standard basketball goal. The receptacle member includes a slotted portion into which a tongue, secured to a basketball goal, may easily slide and be quickly fastened in place. Identical tongue members may be attached to a spacing plate and goal according to my invention as well as to a standard size spacing plate and goal. Thus, in a matter of a few seconds the goal may be changed from a standard form to the larger sized goal with narrow spacing plate of my invention.

A standard basketball goal is usually attached to a back plate which is secured to the backboard by nuts and bolts arranged in a conventional pattern. I have planned my invention so that the back plate of my invention may have a pattern of mounting components, such as nuts and bolts, with suitable holes drilled through the back plate, similar to the pattern of the conventional back plate which my back plate may replace.

In summary, my invention comprises a quick change basketball goal including a receptacle member securable to a basketball backboard, and a goal-mounting member cooperable with the receptacle member. The receptacle member further includes a back plate with a stop lug secured normally thereto, and a guide member on the back plate forming a guide channel on the front portion of the receptacle member. The goal-mounting member includes a tongue member having a longitudinal slot slightly wider than the stop lug, with the slot extending inwardly from a first, or lower end; a spacer member secured normally to the tongue at a second, or upper end of the tongue; and a goal ring secured to the spacer member. The goal-mounting member and the receptacle member are cooperable in a manner that the tongue can slide into the guide channel, the slot can receive the stop lug, and a nut is securable on the stop lug to secure the tongue between the nut and the back plate.

DESCRIPTION OF THE PREFERRED EMBODIMENTS

Figure 1:
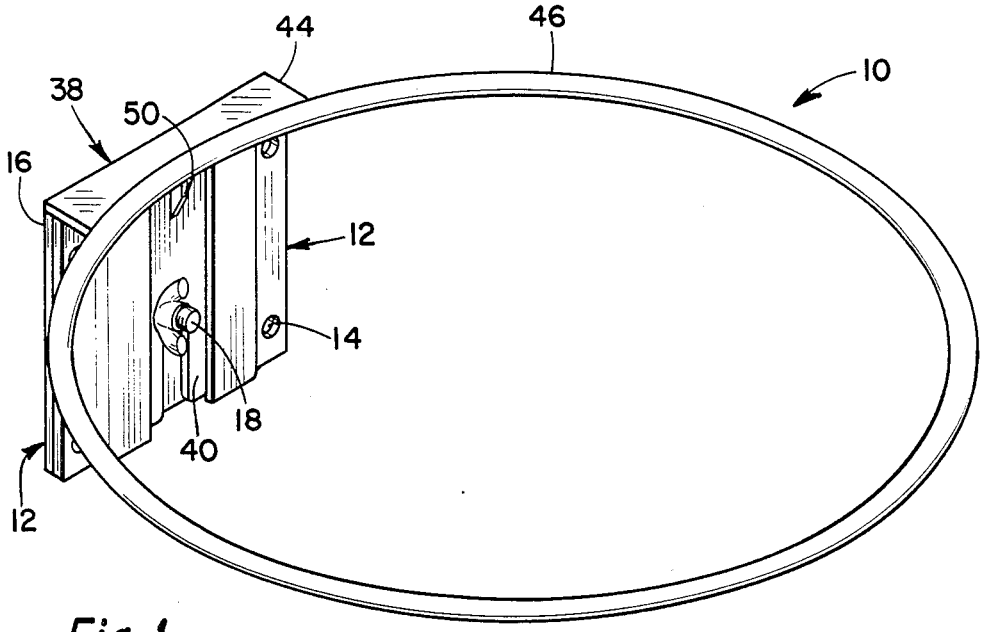
FIG. 1 is a perspective view of a quick change basketball goal system according to my invention showing a receptacle member and a goal-mounting member secured cooperably together.

FIG. 1 is a perspective view of a quick change basketball system 10, generally, according to my invention, as the components would be secured cooperably together in position for mounting on a basketball backboard (not shown). I have not shown a backboard because a typical backboard is simply a flat board member, sometimes stylized in conformation, and sometimes of material other than wood.

Figure 2:
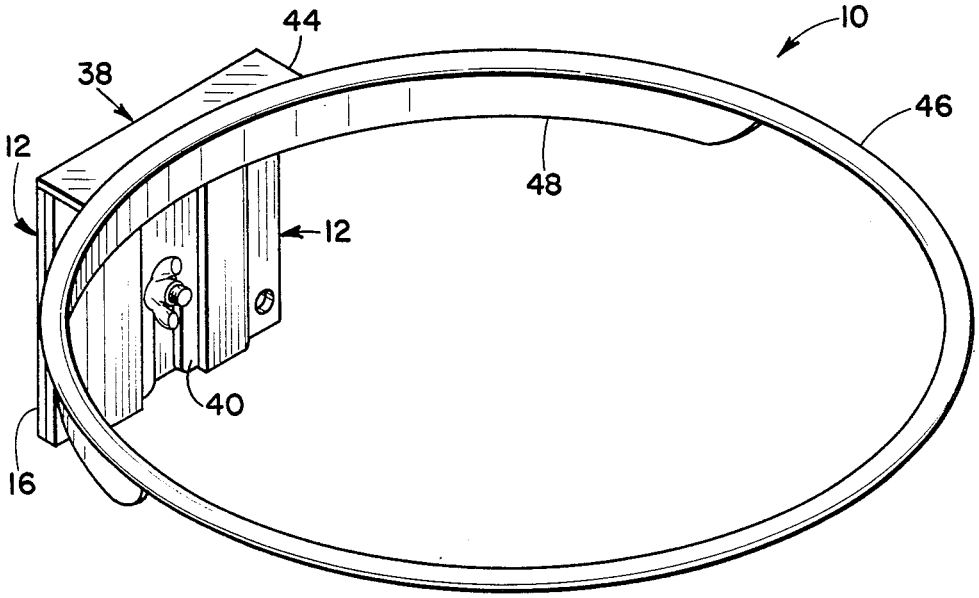
FIG. 2 is a perspective view similar to FIG. 1, but showing a modified embodiment of a goal ring.

FIG. 2, closely related to FIG. 1, as shown, but the difference will be explained later. Then, FIG. 3 will show more clearly the details of my invention.

I have designed a receptacle member 12, generally, which is mountable on a backboard by means of screws, or bolts with cooperating nuts, passing through holes 14 and into or through the backboard. The securing means used for mounting the receptacle member 12 on the backboard are not shown because such means may be any conventional means.

Receptacle member 12 comprises: a back plate 16 intended to be securably flush with the backboard, and includes a stop lug 18; and a pair of guide members 20 which are positioned securably on the back plate 16 in a manner to form a guide channel 22. Guide members 20 have inner longitudinal portions of each, 24 and 26 spaced from the back plate 16 to form guide channel 22 and having edges of each 28 and 30 which preferably should be parallel. Inner portions 24 and 26 have interior surfaces 32 and 34 which preferably should be parallel to front surface 36 of back plate 16.

Guide members 20 may be individual components which are each secured to the back plate 16 by the fastening means which secures the receptacle member 12 to the backboard, or they may be integral parts of the receptacle member, such as may be formed by folding a metal sheet in a manner that the guide members are pressed against the back plate 16 to have the same conformation shown in the figures.

Figure 3:
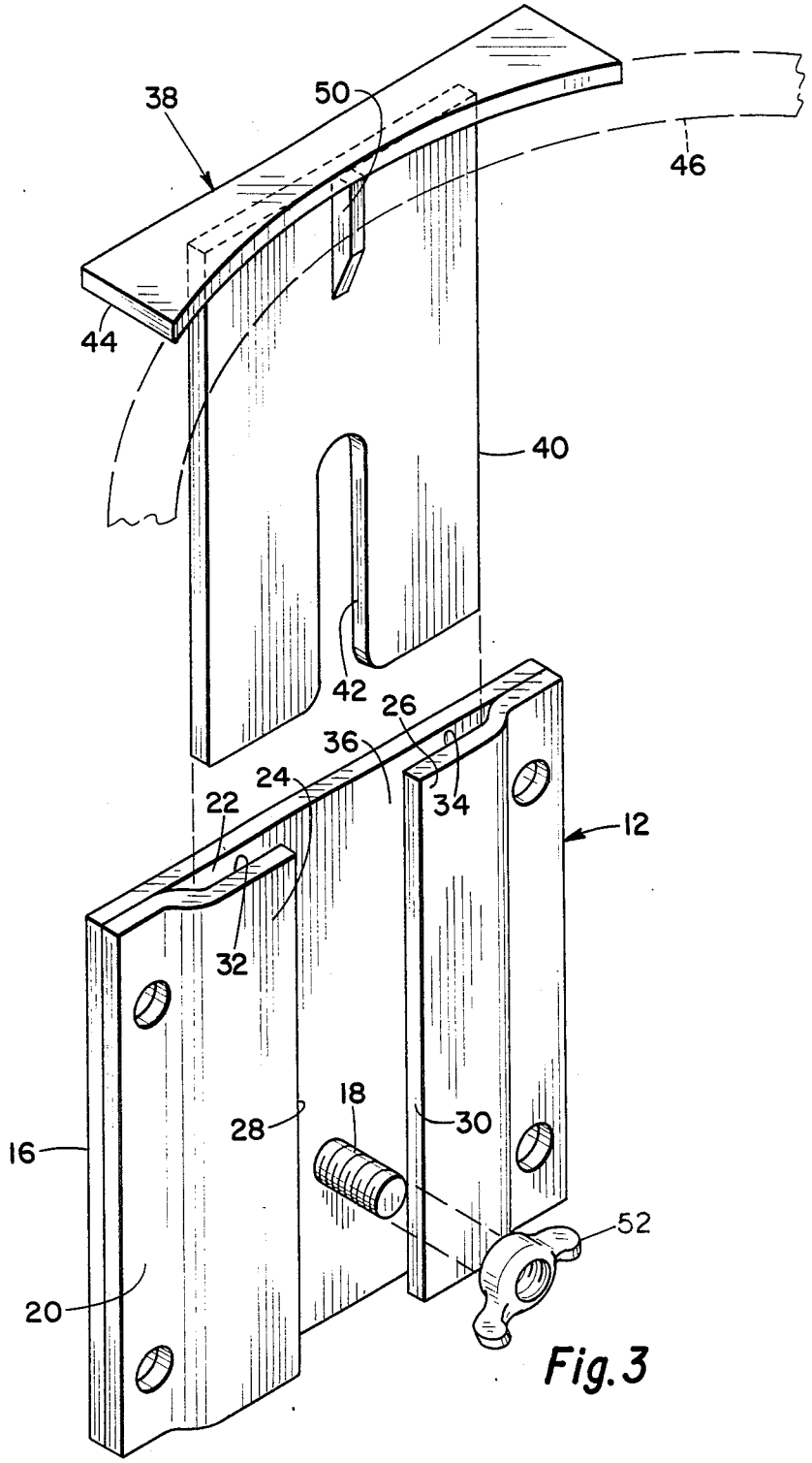
FIG. 3 is a perspective view of cooperable components in a separated condition.

Also, as shown more clearly in FIG. 3, a goal mounting member 38 includes a tongue member 40 adaptable to fit closely and slidably into the guide channel 22. The tongue member 40 has a longitudinal slot 42 slightly wider than the stop lug 18, and the slot 42 extends inwardly from a first, or lower, end of tongue 40 a suitable distance to permit tongue member 40 to be positionable within the guide channel 22 a proper distance so that slot 42 may be clear above stop lug 18 while a spacer member 44, secured normally to the tongue 40, at a second, or upper, end of the tongue 40, may rest upon an upper end of receptacle member 12. As stated above, spacer member 44 is intended to be more narrow than a conventional spacer member, so that a goal ring 46, secured to the spacer member 44, may be positionable more closely to a backboard than a conventional goal ring. As I also discussed above, I have designed my goal ring 46 to be considerably larger than the standard goal ring in order to make the game of basketball more interesting and suitable for players of lesser skill. Thus, for some larger size goal rings, it is necessary to give added support to the goal ring 46, for which I have provided by securing a gusset 48 dependently from a substantial circumferential portion of the goal ring 46. Also, if desired, I provide for a brace 50 secured to tongue 40 and spacer member 44 for added support.

FIG. 3 is, of course, an enlarged view of the receptacle member 12, generally, and goal-mounting member 38, generally, in separate condition, to indicate how those components cooperate. Then, FIGS. 1 and 2 show the quick change device 10, generally, in assembled position, and as the tongue member 40 is held in position by the tightening of a wing nut 52 on stop lug 18.

My system is designed so that goal ring 46 may be either of standard size or enlarged size to permit the players to quickly change from either size as they desire.

Since many different embodiments of this invention may be made without departing from the spirit and scope thereof, it is to be understood that the specific embodiments described in detail herein are not to be taken in a limiting sense, since the scope of the invention is best defined by the appended claims.

I claim:

1. A quick change device for holding a basketball goal comprising:

a receptacle member securable to a basketball backboard including a back plate having a stop bolt secured normally thereto, and a pair of guide members positioned on the back plate to form a guide channel on a front portion of the receptacle member, and a goal-mounting member including a tongue having a longitudinal slot slightly wider than the stop bolt and extending inwardly from a first end, a spacer member secured normally to the tongue at a second end thereof, a goal ring secured to the spacer member, wherein the goal-mounting member and the receptacle member are cooperable in a manner that the tongue can slide into the guide channel, the slot can receive the stop bolt, and a nut is securable on the stop bolt to secure the tongue between the nut and the back plate.

2. A quick change device for holding a basketball goal as described in claim 1, wherein:

the back plate and the guide members are integral.

3. A quick change device for holding a basketball goal as described in claim 2, wherein:

the goal ring includes a gusset member secured dependently therefrom to give support to the goal ring.

4. A quick change device for holding a basketball goal as described in claim 3, wherein:

the gusset member is secured dependently from a substantial circumferential portion of the goal ring.

5. A quick change device for holding a basketball goal as described in claim 1, wherein:

the back plate and the guide members are separate components and are secured together to the backboard.

6. A quick change device for holding a basketball goal as described in claim 5, wherein:

the goal ring includes a gusset member secured dependently therefrom to give support to the goal ring.

7. A quick change device for holding a basketball goal as described in claim 6, wherein:

the gusset member is secured dependently from a substantial circumferential portion of the goal ring.

8. A quick change device for holding a basketball goal as described in claim 1, wherein:

the guide members are securable adjacent an outer edge of each to the back plate, and an inner longitudinal portion of each guide member is spaced from the back plate to form the guide channel.

9. A quick change device for holding a basketball goal as described in claim 8, wherein:

the goal ring includes a gusset member secured dependently therefrom to give support to the goal ring.

10. A quick change device for holding a basketball goal as described in claim 9, wherein:

the gusset member is secured dependently from a substantial circumferential portion of the goal ring.

11. A quick change device for holding a basketball goal as described in claim 1, wherein:

the goal ring includes a gusset member secured dependently therefrom to give support to the goal ring.

12. A quick change device for holding a basketball goal as described in claim 5, wherein:

the gusset member is secured dependently from a substantial circumferential portion of the goal ring.

* * * * *